US008502631B2

(12) United States Patent
Cavender et al.

(10) Patent No.: US 8,502,631 B2
(45) Date of Patent: Aug. 6, 2013

(54) THREE-PHASE LINE REACTOR WITH SKEW YOKE CORE DESIGN

(75) Inventors: David Cavender, Warren, OH (US); William Martin, Warren, OH (US)

(73) Assignee: Ajax Tocco Magnethermic Corporation, Warren, OH (US)

( * ) Notice: Subject to any disclaimer, the term of this patent is extended or adjusted under 35 U.S.C. 154(b) by 0 days.

(21) Appl. No.: 13/591,313

(22) Filed: Aug. 22, 2012

(65) Prior Publication Data

US 2013/0049912 A1 Feb. 28, 2013

Related U.S. Application Data

(60) Provisional application No. 61/527,390, filed on Aug. 25, 2011.

(51) Int. Cl.

| | |
|---|---|
| ***H01F 30/12*** | (2006.01) |
| ***H01F 27/28*** | (2006.01) |
| ***H01F 27/24*** | (2006.01) |

(52) U.S. Cl.

USPC ..... 336/5; 336/182; 336/183; 336/170; 336/212

(58) Field of Classification Search

USPC ..... 336/5, 182, 183, 170, 212

See application file for complete search history.

(56) References Cited

U.S. PATENT DOCUMENTS

| | | | | | |
|---|---|---|---|---|---|
| 644,565 | A | * | 3/1900 | Arnold | 336/215 |
| 2,431,155 | A | * | 11/1947 | Woolfolk | 336/212 |
| 2,594,001 | A | * | 4/1952 | Ellis et al. | 336/215 |
| 2,958,931 | A | * | 11/1960 | Hurt, Jr. | 29/609 |
| 3,195,081 | A | * | 7/1965 | Kunes | 336/5 |
| 3,195,090 | A | * | 7/1965 | Burkhardt et al. | 336/218 |
| 7,768,373 | B2 | | 8/2010 | Shudarek | |
| 2005/0280489 | A1 | | 12/2005 | Talja et al. | |
| 2006/0001516 | A1 | * | 1/2006 | Mazur et al. | 336/5 |
| 2008/0094159 | A1 | | 4/2008 | Sodo | |

* cited by examiner

*Primary Examiner* — Elvin G Enad
*Assistant Examiner* — Ronald Hinson
(74) *Attorney, Agent, or Firm* — Fay Sharpe LLP

(57) ABSTRACT

A line reactor is presented having a skewed core structure with three horizontally non-coplanar vertical legs and top and bottom laminated, interleaved yoke structures with corresponding horizontally non-coplanar yoke ends.

19 Claims, 9 Drawing Sheets

THREE-PHASE LINE REACTOR WITH SKEW YOKE CORE DESIGN

REFERENCE TO RELATED APPLICATION

This application claims priority to and the benefit of U.S. Provisional Patent Application Ser. No. 61/527,390, filed Aug. 25, 2011, entitled THREE-PHASE LINE REACTOR WITH SKEW YOKE CORE DESIGN, the entirety of which is hereby incorporated by reference.

FIELD OF THE INVENTION

The present disclosure relates generally to line reactors and more particularly to small form factor three-phase line reactors.

BACKGROUND OF THE INVENTION

Line reactors are used to isolate electrical components in electrical systems such as motor drives, power supplies, etc. in order to dampen harmonics and transients occurring in power distribution systems. Multiphase line reactors are commonly employed with individual reactors connected in series in multiphase power lines to address common mode and differential mode transients. These line reactor assemblies are typically constructed using a shared core structure with three vertical legs arranged in a common plane and joined by upper and lower horizontal legs, where the three individual phase windings are wound around a corresponding one of the vertical legs. However, these conventional line reactor assembly configurations are bulky and improved designs are desired by which increased short-circuit current ratings are possible without increasing the overall size of the line reactor assembly.

SUMMARY OF INVENTION

One or more aspects of the disclosure are now summarized to facilitate a basic understanding of the disclosure, wherein this summary is not an extensive overview of the disclosure, and is intended neither to identify certain elements of the disclosure, nor to delineate the scope thereof. The primary purpose of the summary, rather, is to present some concepts of the disclosure in a simplified form prior to the more detailed description that is presented hereinafter. The present disclosure relates to an improved three-phase line reactor apparatus to facilitate the ability to withstand higher short-circuit currents while occupying the same or smaller area within an electrical power conversion system. A three-phase line reactor apparatus is provided, which includes top and the bottom yoke structures, each having three horizontally non-coplanar ends, which in certain embodiments are angularly spaced at approximately 120° relative to one another. The core structure further includes three horizontally non-coplanar core leg structures each extending between a corresponding pair of the top and bottom yoke ends. In certain embodiments, one or both of the top and bottom yoke structures includes a center opening. The line reactor apparatus further includes windings formed at least partially around each of the three core leg structures, which can include one or more taps in certain embodiments. The disclosed core structure thus provides vertical core legs only for the phase windings. In certain embodiments, one or both of the yoke structures is fabricated using three yoke portions, each having a first end forming part of one of the yoke structure ends as well as a center and a second end forming part of another one of the yoke structure ends, where the yoke portions may be laminated structures made of iron material. In certain embodiments, moreover, the yoke portion ends may be disposed approximately at 30° angles relative to the yoke portion center. The yoke portions in certain embodiments are comprised of two sets of angled laminations with the center of each such yoke portion including interleaved ends of the two sets of angled laminations, where the angled laminations of the yoke portions are formed that an angle of approximately 30°. In certain embodiments, one or more of the core leg structures may include at least one gap, which may be a solid material, and the core leg structures may comprise a plurality of core leg structure segments with at least one gap between two adjacent core leg structure segments, and the legs segments may be laminated stacks of iron or other core material.

BRIEF DESCRIPTION OF THE DRAWINGS

The following description and drawings set forth certain illustrative implementations of the disclosure in detail, which are indicative of several exemplary ways in which the principles of the disclosure may be carried out. The illustrated examples, however, are not exhaustive of the many possible embodiments of the disclosure. Other objects, advantages and novel features of the disclosure will be appreciated from the following detailed description of the disclosure when considered in conjunction with the drawings, in which.

DETAILED DESCRIPTION OF THE INVENTION

Figure 1:
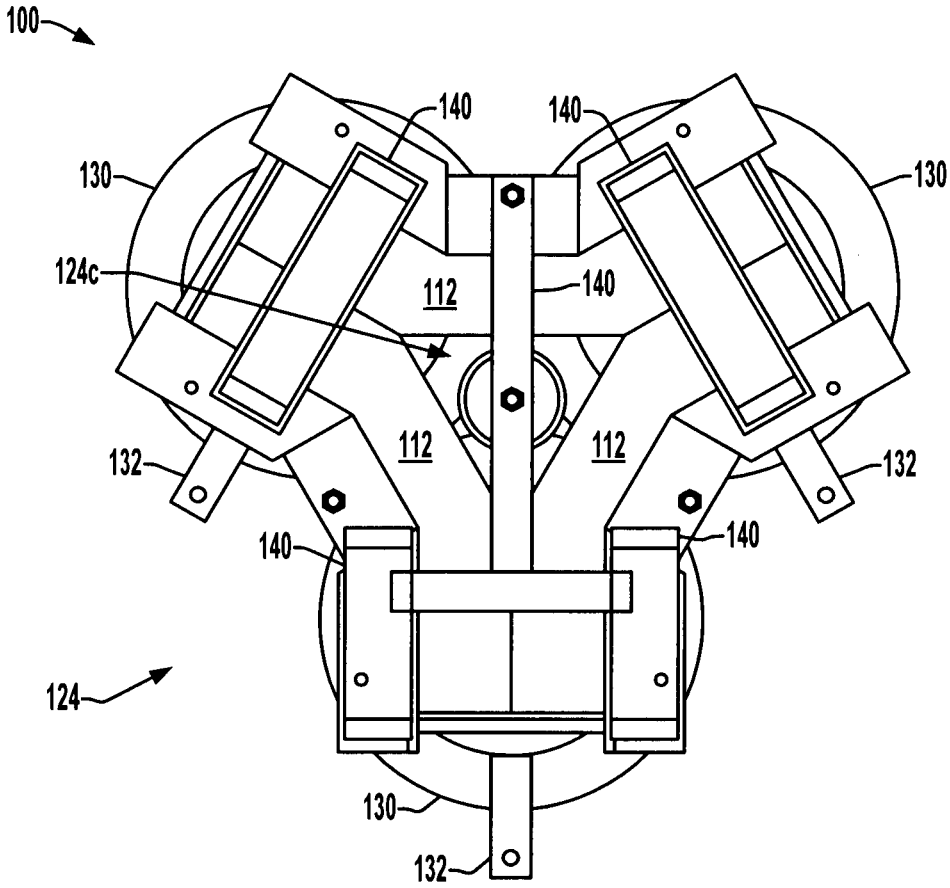
FIG. 1 is a top plan view illustrating an exemplary three-phase line reactor apparatus with a skew yoke core design having phase windings and corresponding core legs disposed at 120° angular spacing from one another.

Referring now to the figures, several embodiments or implementations of the present disclosure are hereinafter described in conjunction with the drawings, wherein like reference numerals are used to refer to like elements throughout. The disclosure provides improved three-phase line reactors using a skewed core design to facilitate construction of compact reactor apparatus to provide a desired level of transient suppression, whether common mode and/or differential mode with high short-circuit withstanding rating.

Figure 2:
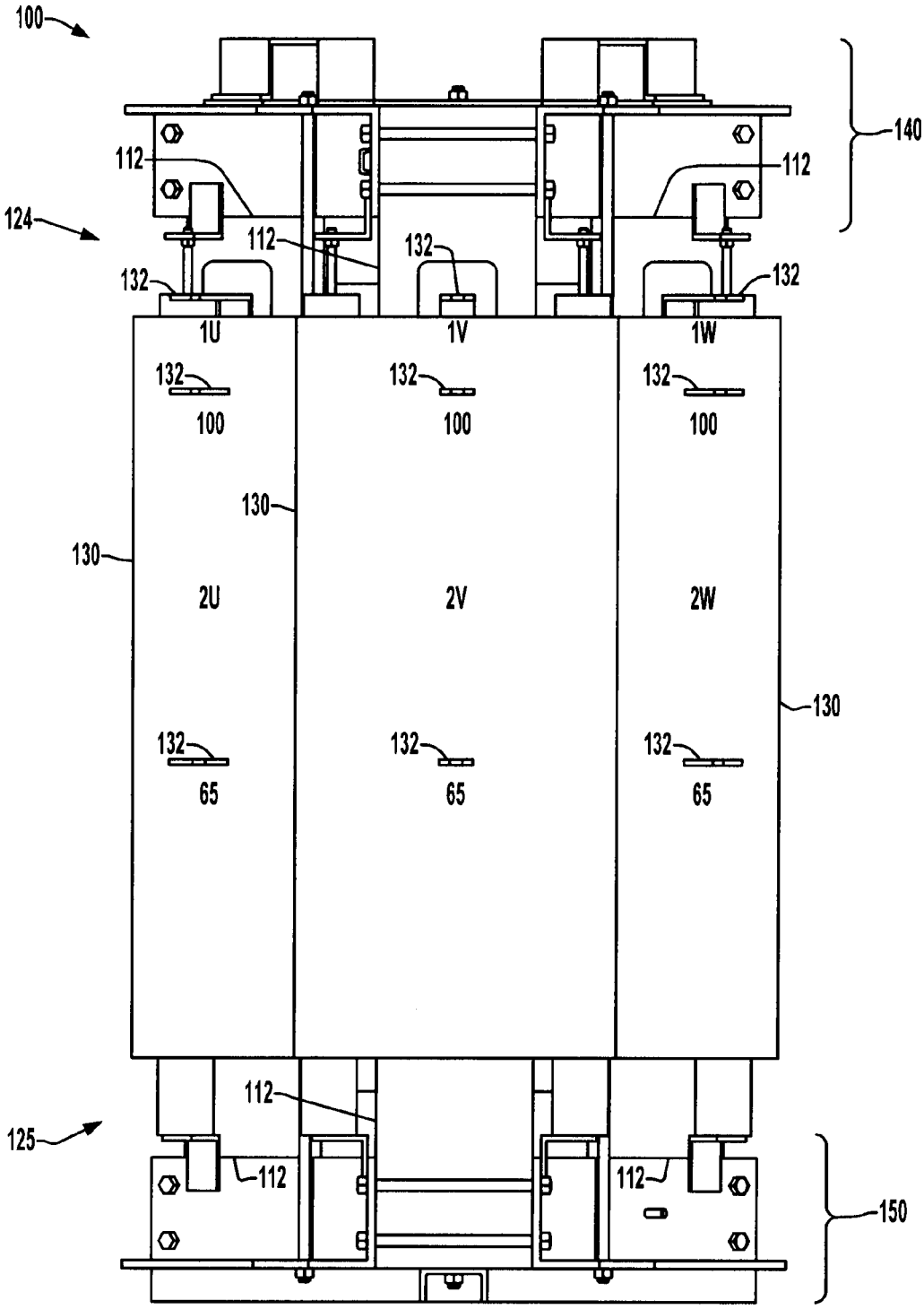
FIG. 2 is a front elevation view of the three-phase line reactor apparatus of FIG. 1 including an upper lifting bracket structure and a lower base.
Figure 3:
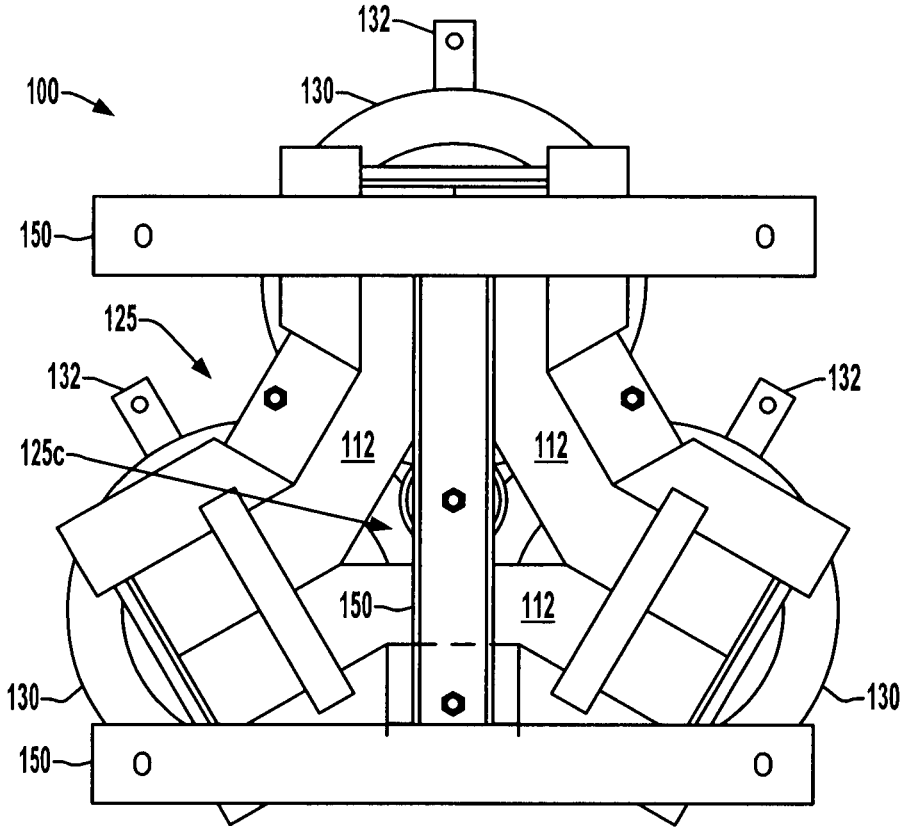
FIG. 3 is a bottom plan view illustrating the three-phase line reactor apparatus of FIGS. 1 and 2.
Figure 4:
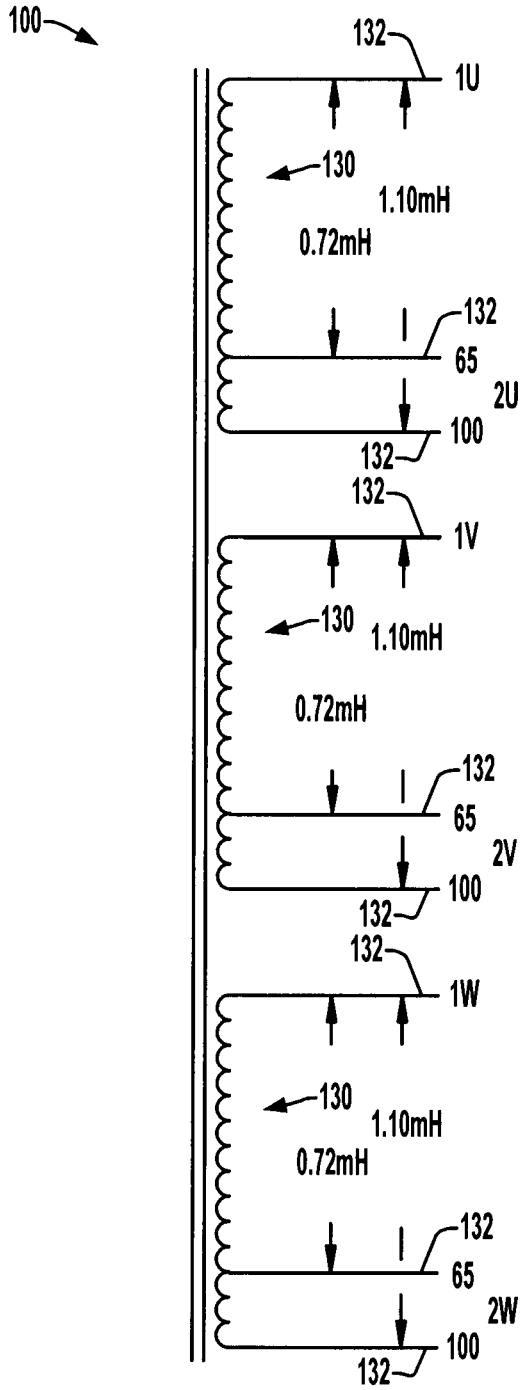
FIG. 4 is a schematic diagram illustrating the three tapped phase windings of the line reactor apparatus and corresponding connection terminals.

Referring initially to FIGS. 1-4, an exemplary three-phase line reactor apparatus 100 is illustrated, having a novel skewed three-phase common core structure 110 as well as individual tapped phase windings 130, where FIG. 4 illustrates a schematic representation of the windings 130 and associated connections 132 for the winding ends and the taps. As seen in the top and front views of FIGS. 1 and 2, the apparatus 100 may include a lifting bracket structure 140, and FIGS. 2 and 3 illustrate a mounting base structure 150 disposed at the bottom of the apparatus 100. In addition, the illustrated embodiment includes coupling connections 132 for each of the phase windings 130 by which electrical connection can be made to the windings 130. The connections in this example include upper connections 132 (1U, 1V, and 1W for the upper ends of the windings 130 shown schematically in FIG. 4), as well as three individual pairs of lower connections for each phase (2U, 2V and 2W), each including a tap connection 132 (labeled "65" in FIG. 2) and a lower and connection (labeled "100"), where 100% of the rated phase inductance can be achieved in each phase by connection to the "100" terminal 132 and a smaller phase inductance value (e.g., 65% in one example) can be achieved by connection to the "65" terminal 132.

Figure 5:
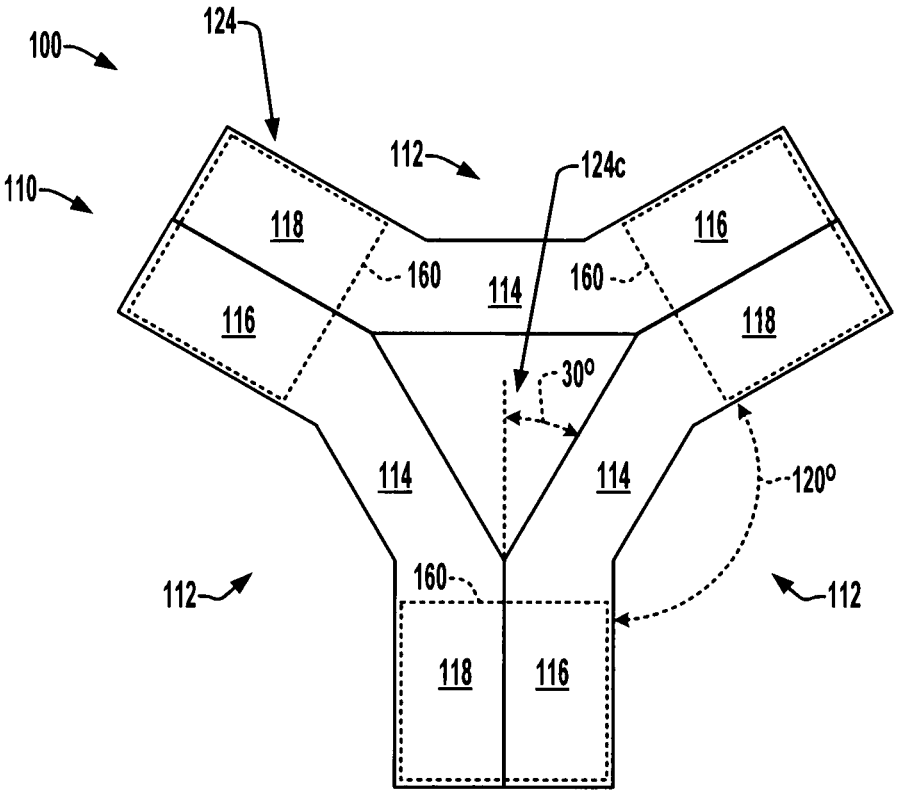
FIG. 5 is a simplified top plan view illustrating the core structure including assembled upper yoke portions of the three-phase line reactor apparatus of FIGS. 1-4.
Figure 6:
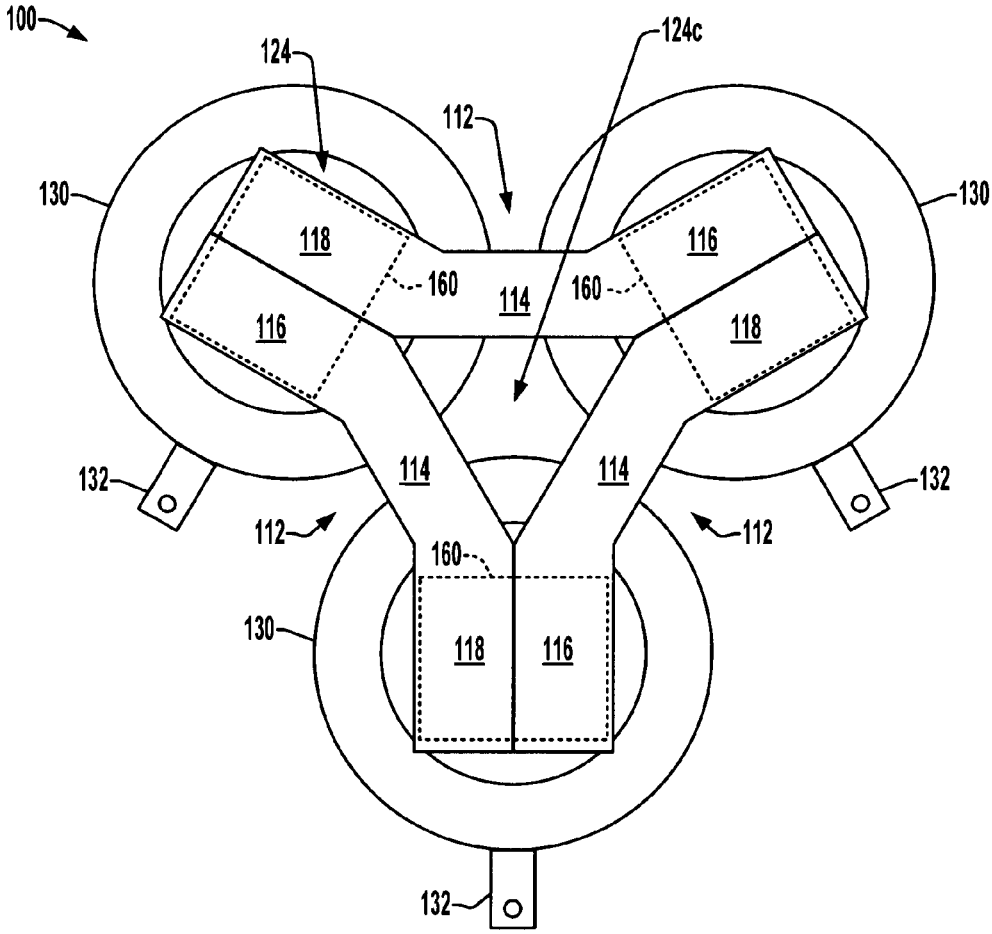
FIG. 6 is a simplified top plan view illustrating the core structure and corresponding phase windings of the line reactor apparatus of FIGS. 1-5.
Figure 9:
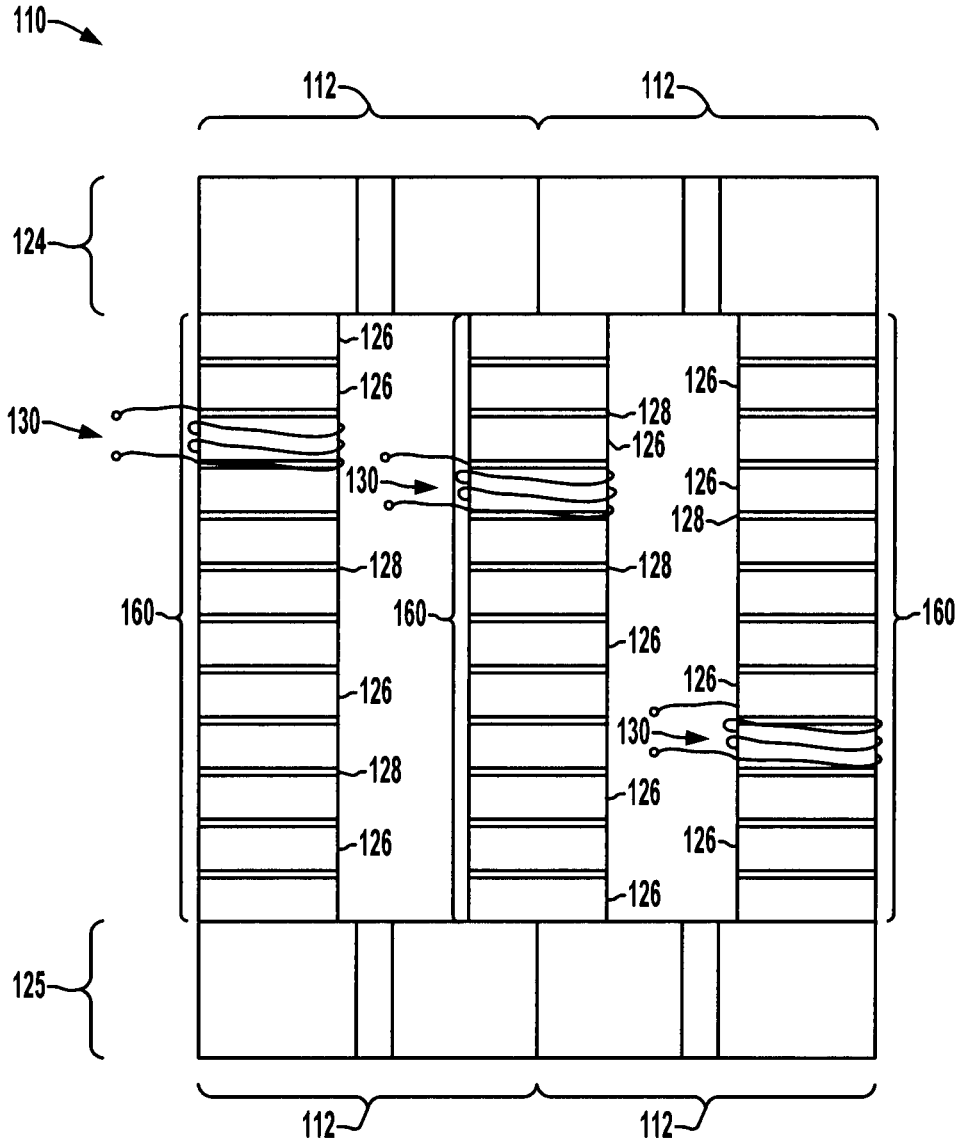
FIG. 9 is a front elevation view illustrating the assembled core structure of the line reactor of FIGS. 1-6.

Referring also to FIGS. 5, 6 and 9, FIGS. 5 and 6 show top plan views of the skewed core structure 110 of the reactor apparatus 100, with FIG. 6 illustrating coil windings 130 disposed about vertical core legs 160 of the core structure 110. FIG. 9 provides a front elevation view of the assembled core structure 110 of the line reactor apparatus 100, in which the windings 130 are illustrated in simplified form. As best seen in FIGS. 5 and 6, the core structure 110 includes a top yoke structure 124 comprised of three yoke portions 112, each having a first end 116, a center 114, and a second end 118. The assembled top yoke structure 124 has first, second and third ends, each formed by a corresponding pair of ends 116, 118 of two of the yoke portions 112, where the yoke structure ends are spaced from one another and from the center of the yoke structure 124 in a common horizontal plane, and the yoke structure ends are angularly spaced relative to one another by an angle of approximately 120° as shown. In this embodiment, moreover, the top yoke structure 124 includes a center opening 124*c*, in this case generally triangular in shape, although other embodiments are possible in which the opening has a different shape and/or in which the upper yoke structure 124 has no center opening. As seen in FIG. 3, moreover, the lower (e.g., bottom) yoke structure 125 is similarly constructed in the illustrated embodiment, having three yoke portions 112, each with a center and two ends disposed at 30° angles, as well as an optional (e.g., triangular) center opening 125*c*.

As seen in FIG. 9, the core leg structures 160 extend generally vertically between the corresponding ends of the upper and lower yoke structures 124, 125, where a corresponding winding 130 is provided at least partially around each of the core legs 160, whereby each core leg 160 and corresponding winding 130 correspond to one of the electrical phase lines (e.g., U, V, W), and the core structure 110 has no central leg. The core legs 160 may be fashioned in any suitable manner, and may be solid or laminated unitary structures extending between the yokes 124 and 125. In the illustrated embodiment, moreover, each core leg structure 160 includes a plurality of segments 126, each of which may be laminated core material or solid core material, such as iron in certain embodiments. In addition, the exemplary core leg structures 160 each include one or more gaps 128 although not strictly required for all possible embodiments. In the illustrated embodiment, gaps 128 are provided between each adjacent pair of the core leg structure segments 126. In certain embodiments, one or more of the gaps 128 may be air gaps, or may be filled with solid material, such as Nomex 410 and glastic material. In certain embodiments, the core leg structure segments 126 are generally rectangular laminated stacks of core material, such as iron, although other profiles and shapes can be used. In the illustrated example, the skewed orientation of the yoke structure ends and the corresponding location of the core legs 160 extending between a corresponding pair of upper and lower yoke ends, along with the segment/gap structure 126/128 of the legs 160, provides phase winding widths of approximately 6 inches or more and winding window height of approximately 26 inches or more for segment widths of approximately 7 inches for a design to accommodate over 600 A AC and a nominal phase inductance of over 1 mH, for an apparatus 100 having a lateral depth and lateral width dimension of approximately 31 inches, although the various concepts disclosed herein can be used in Association with any particular design specifications.

Figure 7:
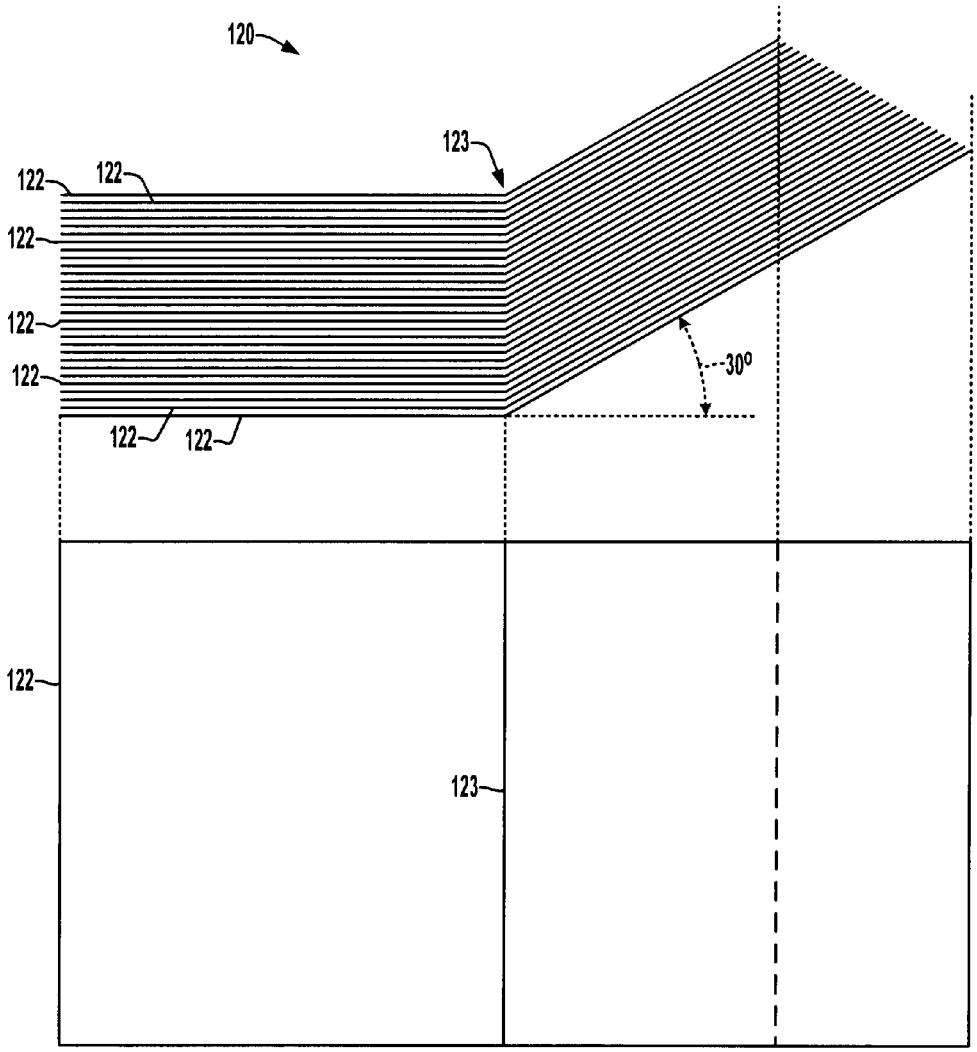
FIG. 7 illustrates top plan and side elevation views of an exemplary set of angled upper yoke laminations in the line reactor apparatus of FIGS. 1-6.
Figure 8:
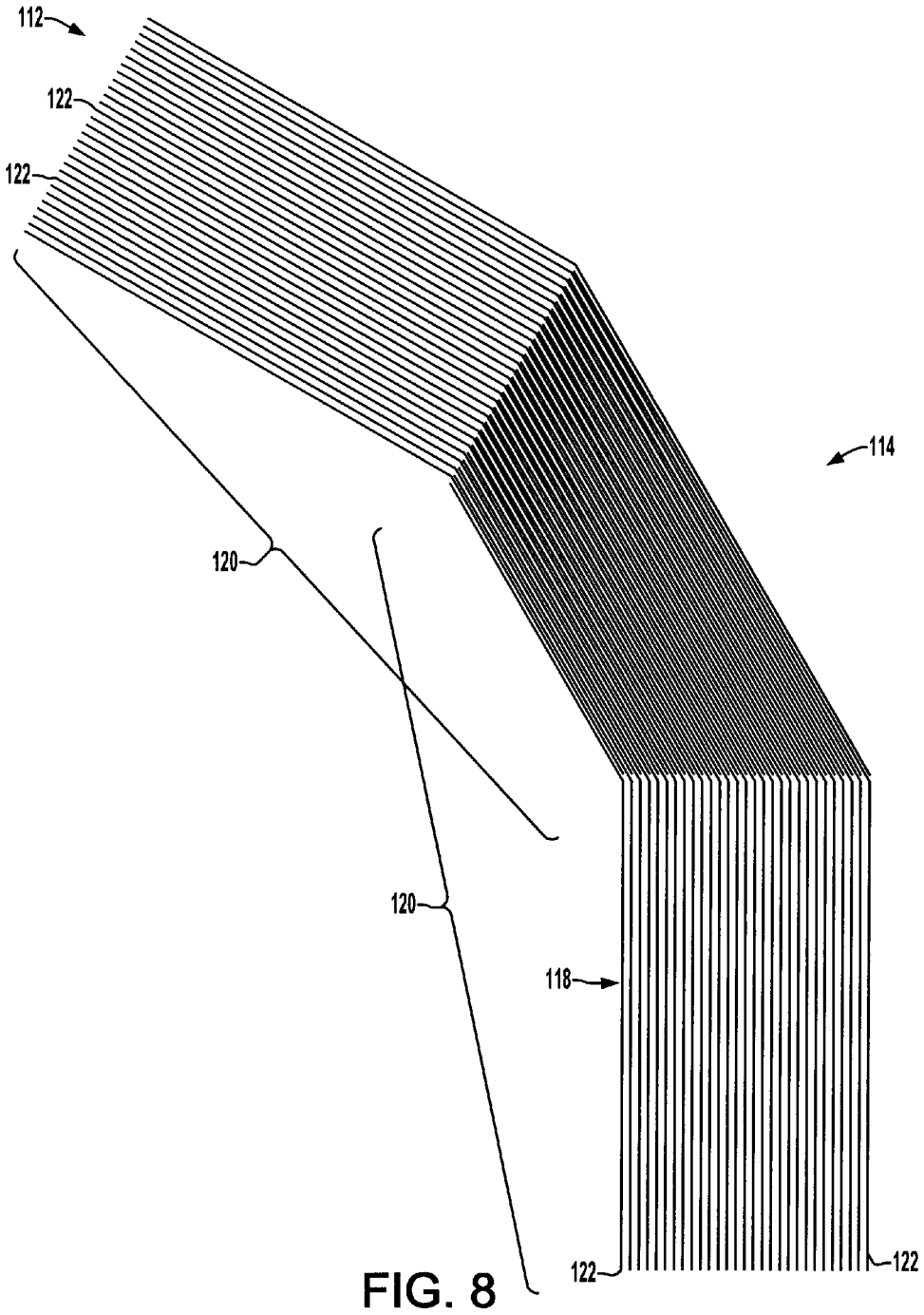
FIG. 8 is a top plan view illustrating an upper yoke portion including two interleaved angled lamination sets.

Referring also to FIGS. 7 and 8, FIG. 7 illustrates top and side views of an exemplary set 120 of angled upper yoke laminations 122, where the individual laminations 122 each include a bend 123 to provide an angled laminate structure bent at approximately a 30° angle. The yoke laminations 122 in certain embodiments are iron core material. In certain embodiments, moreover, two such sets 120 of angled laminations 122 are assembled as shown in FIG. 8 to form each of the yoke portions 112. In particular, the center 114 of the yoke portion 112 includes interleaved ends of the two sets 120 of angled laminations 122 in certain embodiments, with the first and second portion ends 116 and 118 having no such interleaving. Thus constructed, the illustrated yoke portion 112 has a first end 116 disposed at approximately a 30° angle with respect to the center portion 114, and the second portion end 118 is likewise at approximately a 30° angle relative to the center 114.

As best seen above in FIGS. 5 and 6, the relative orientation of three such yoke portions 112 provides a skewed core yoke structure (top and bottom yokes 124 and 125 in the illustrated embodiment) in which the yokes each have three ends angularly spaced from one another at approximately 120° angles, with each end of the yoke being defined by two of the yoke portion ends 116, 118. The provision of the intervening vertical core leg structures 160 extending between corresponding yoke structure ends of the upper and lower yokes 124 and 125 provides for 120° angular positioning of the corresponding phase windings 130 of the three-phase line reactor apparatus 100 (e.g., FIGS. 1-3 above).

The disclosed structure advantageously provides skewed coil positioning relative to conventional (in-line) multiphase line reactor designs, whereby a more compact form factor can be achieved. This can facilitate incorporation into more compact enclosures for a given electrical power system, while allowing the design of the core and winding specifics to accommodate a given set of electrical specifications, including the ability to withstand short-circuit currents, inductance requirements, etc. Moreover, the coil windings 130 in certain embodiments are generally circular (e.g., as seen in FIG. 6 above), and the 120° relative positioning of the three phases (U, V, W) facilitates the use of a circular winding structure 130, thereby facilitating high current carrying capacity and the ability to withstand short-circuit currents, whereas conventional in-line designs have difficulty accommodating circular windings while still achieving compact form factor.

The above examples are merely illustrative of several possible embodiments of various aspects of the present disclosure, wherein equivalent alterations and/or modifications will occur to others skilled in the art upon reading and understanding this specification and the annexed drawings. In particular regard to the various functions performed by the above described components (assemblies, devices, systems, and the like), the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the illustrated implementations of the disclosure. In addition, although a particular feature of the disclosure may have been disclosed with respect to only one of several implementations, such feature may be combined with one or more other features of the other implementations as may be desired and advantageous for any given or particular application. Also, to the extent that the terms "including", "includes", "having", "has", "with", or variants thereof are used in the detailed description and/or in the claims, such terms are intended to be inclusive in a manner similar to the term "comprising".

Having thus described the invention, the following is claimed:

1. A three-phase line reactor apparatus, comprising:

a core structure, comprising:

a top yoke structure having first, second and third ends spaced from one another and from a top yoke structure center in a common top horizontal plane, the first, second and third ends being horizontally non-coplanar, a bottom yoke structure having first, second, and third ends spaced from one another and from a bottom yoke structure center in a common bottom horizontal plane, the first, second, and third ends of the bottom yoke structure being horizontally non-coplanar and generally vertically aligned with the first, second, and third ends of the top yoke structure, a first core leg structure extending between the first end of the top yoke structure and the first end of the bottom yoke structure, a second core leg structure extending between the second end of the top yoke structure and the second end of the bottom yoke structure, and a third core leg structure extending between the third end of the top yoke structure and the third end of the bottom yoke structure;

a first winding formed at least partially around the first core leg structure;

a second winding formed at least partially around the second core leg structure; and a third winding formed at least partially around the third core leg structure;

wherein at least one of the top yoke structure and the bottom yoke structure comprise three yoke portions, each yoke portion having a first end forming part of one of the yoke structure ends, a center, and a second end forming part of another one of the yoke structure ends;

wherein each yoke portion is a laminated structure; and wherein each yoke portion comprises two sets of angled laminations, with the center of each yoke portion including interleaved ends of the two sets of angled laminations.

2. The three-phase line reactor apparatus of claim 1, wherein the first, second and third ends of the top yoke structure are angularly spaced at approximately 120° relative to one another, and wherein the first, second, and third ends of the bottom yoke structure are angularly spaced at approximately 120° relative to one another.

3. The three-phase line reactor apparatus of claim 1, wherein at least one of the top yoke structure and the bottom yoke structure includes a center opening.

4. The three-phase line reactor apparatus of claim 1, wherein the angled laminations of the yoke portions are formed at an angle of approximately 30°.

5. The three-phase line reactor apparatus of claim 4, wherein the angled laminations of the yoke portions are made of iron material.

6. The three-phase line reactor apparatus of claim 1, wherein the angled laminations of the yoke portions are made of iron material.

7. The three-phase line reactor apparatus of claim 1, wherein the first end and the center of the individual yoke portions extend at approximately a 30° angle relative to one another, and wherein the second end and the center of the individual yoke portions extend at approximately a 30° angle relative to one another.

8. The three-phase line reactor apparatus of claim 1, wherein at least one of the core leg structures comprises at least one gap.

9. The three-phase line reactor apparatus of claim 8, wherein the at least one of the core leg structures comprises a plurality of core leg structure segments, and at least one gap between two adjacent core leg structure segments.

10. The three-phase line reactor apparatus of claim 9, wherein the at least one gap comprises a solid material.

11. The three-phase line reactor apparatus of claim 8, wherein the at least one gap comprises a solid material.

12. The three-phase line reactor apparatus of claim 11, wherein the at least one gap comprises Nomex 410 and glastic solid material.

13. The three-phase line reactor apparatus of claim 9, wherein the core leg structure segments are laminated stacks of core material.

14. The three-phase line reactor apparatus of claim 13, wherein the core material comprises iron.

15. The three-phase line reactor apparatus of claim 9, wherein the core leg structure segments are made of iron material.

16. The three-phase line reactor apparatus of claim 8, wherein the core leg structures are made of iron material.

17. The three-phase line reactor apparatus of claim 1, wherein the core leg structures are made of iron material.

18. The three-phase line reactor apparatus of claim 1, wherein the windings include at least one tap.

19. The three-phase line reactor apparatus of claim 1, wherein each set of angled laminations extends to only one yoke structure end.

* * * * *